US007255099B2

(12) United States Patent
Henry

(10) Patent No.: US 7,255,099 B2
(45) Date of Patent: Aug. 14, 2007

(54) BOW PRESS

(76) Inventor: Donald J Henry, P.O. Box 28, Route 220, New Albany, PA (US) 18833

( * ) Notice: Subject to any disclaimer, the term of this patent is extended or adjusted under 35 U.S.C. 154(b) by 0 days.

(21) Appl. No.: 11/164,630

(22) Filed: Nov. 30, 2005

(65) Prior Publication Data

US 2006/0191522 A1 Aug. 31, 2006

Related U.S. Application Data

(60) Provisional application No. 60/593,266, filed on Dec. 30, 2004.

(51) Int. Cl.
*F41B 5/14* (2006.01)

(52) U.S. Cl. ..... 124/1; 124/86

(58) Field of Classification Search ..... 124/1, 124/23.1, 80, 86
See application file for complete search history.

(56) References Cited

U.S. PATENT DOCUMENTS

| | | | | |
|---|---|---|---|---|
| 5,370,103 | A * | 12/1994 | Desselle | 124/86 |
| 5,433,186 | A * | 7/1995 | Corwin | 124/86 |
| 6,220,235 | B1 * | 4/2001 | Sands | 124/1 |
| 6,386,190 | B1 * | 5/2002 | Kurtz, Jr. | 124/1 |
| 6,932,070 | B1 * | 8/2005 | Kurtz, Jr. | 124/1 |

* cited by examiner

*Primary Examiner*—John A. Ricci
(74) *Attorney, Agent, or Firm*—John J. Elnitski, Jr.

(57) ABSTRACT

A bow press for securing an archery bow having limbs. The bow press has a main frame to support other components of the bow press. The main frame includes a main frame cross member, an adjustment mechanism mounted to the main frame, a bow limb flexing assembly mounted to the main frame cross member adapted for receiving the archery bow, and a limb inside contact assembly adapted to secure the archer bow against the bow limb flexing assembly and mounted to the adjustment mechanism, whereby the limb inside contact assembly can be moved to due to actuation of the adjustment mechanism.

26 Claims, 18 Drawing Sheets

BOW PRESS

BACKGROUND

The present invention generally relates to servicing of archery bows. More specifically, the present invention relates to a bow press used to bend limbs of an archery bow to allow servicing of the archery bow.

Bow presses currently in use tend to be cumbersome to use when servicing an archery bow. Bow presses currently in use put stress on the archery bow due to the where the limbs are bent to service the archery bow. What is need is an easy to use bow press which reduces the stress on the limbs of the archery bow.

It is an object of the present invention to provide a bow press to service archery bows.

SUMMARY OF THE INVENTION

A bow press for securing an archery bow having limbs. The bow press has a main frame to support other components of the bow press. The main frame includes a main frame cross member, an adjustment mechanism mounted to the main frame, a bow limb flexing assembly mounted to the main frame cross member adapted for receiving the archery bow, and a limb inside contact assembly adapted to secure the archer bow against the bow limb flexing assembly and mounted to the adjustment mechanism, whereby the limb inside contact assembly can be moved to due to actuation of the adjustment mechanism.

DETAILED DESCRIPTION

Figure 1:
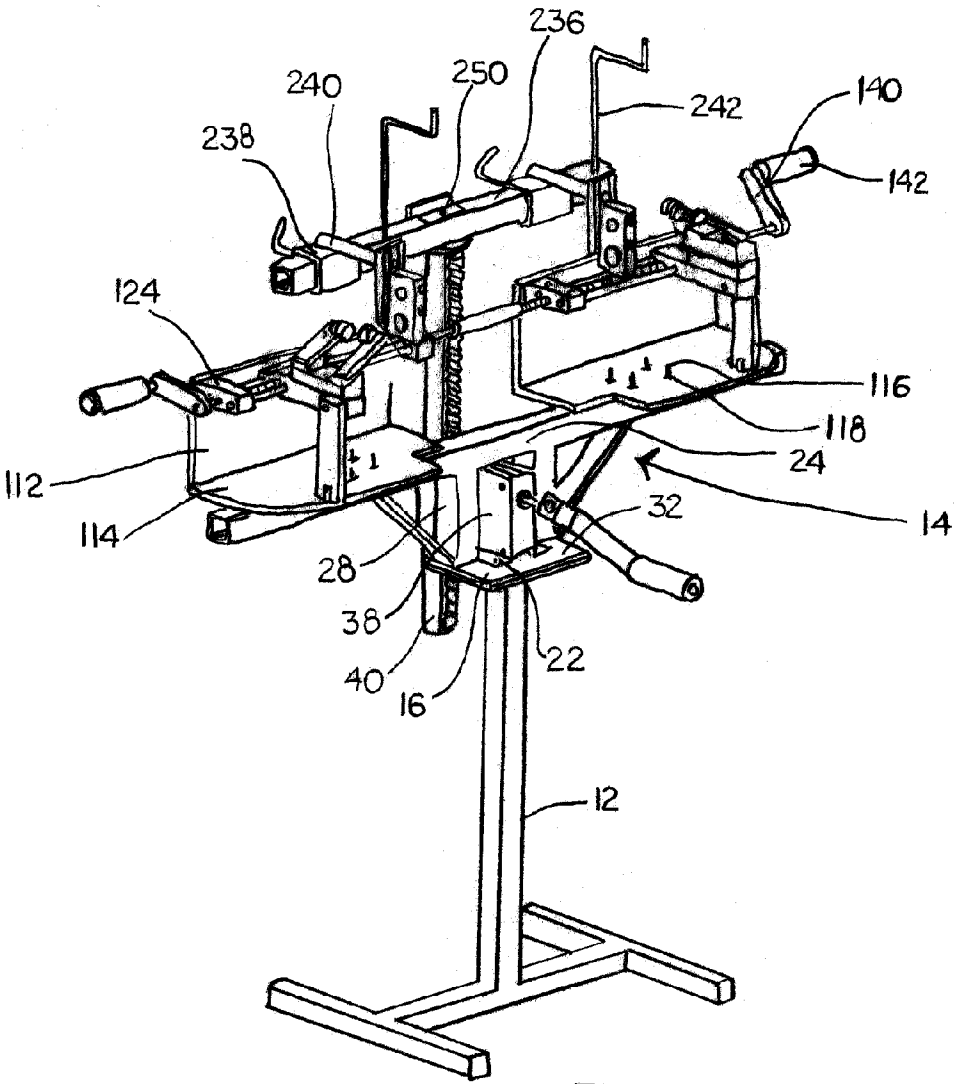
FIG. 1 is a perspective view of a bow press according to the present invention.
Figure 2:
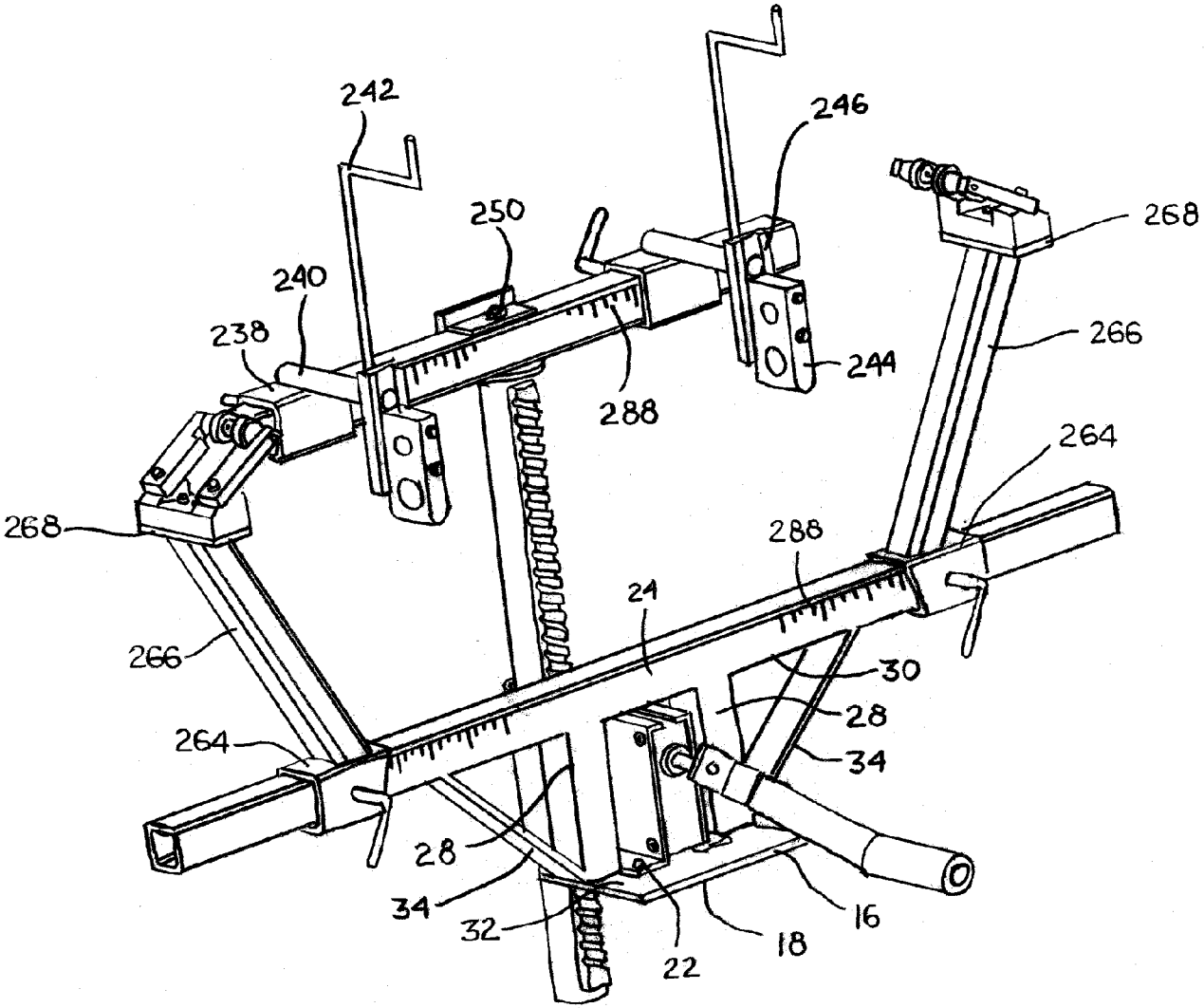
FIG. 2 is a perspective view of a bow press according to the present invention.
Figure 3:
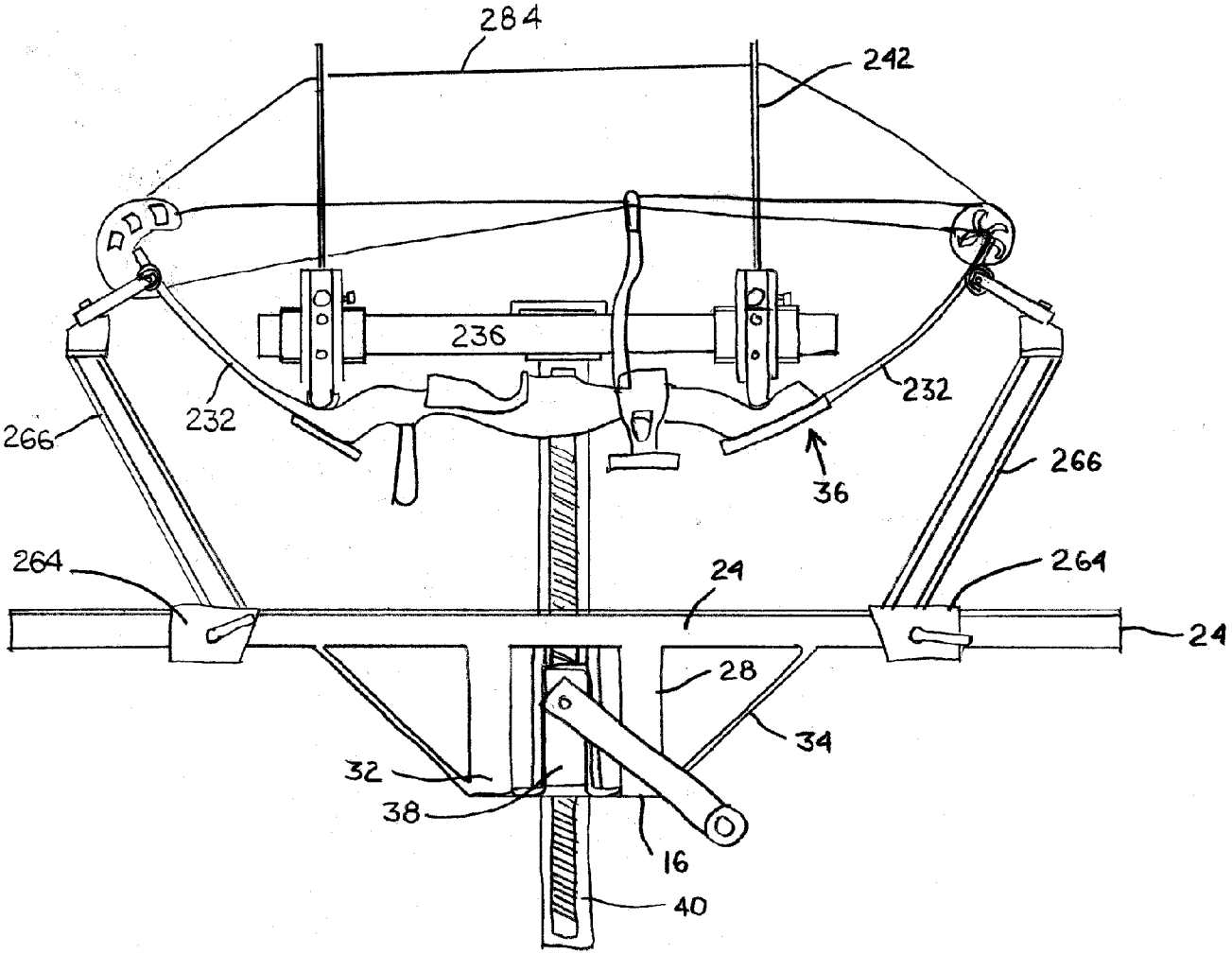
FIG. 3 is a front view of a bow press according to the present invention.
Figure 11:
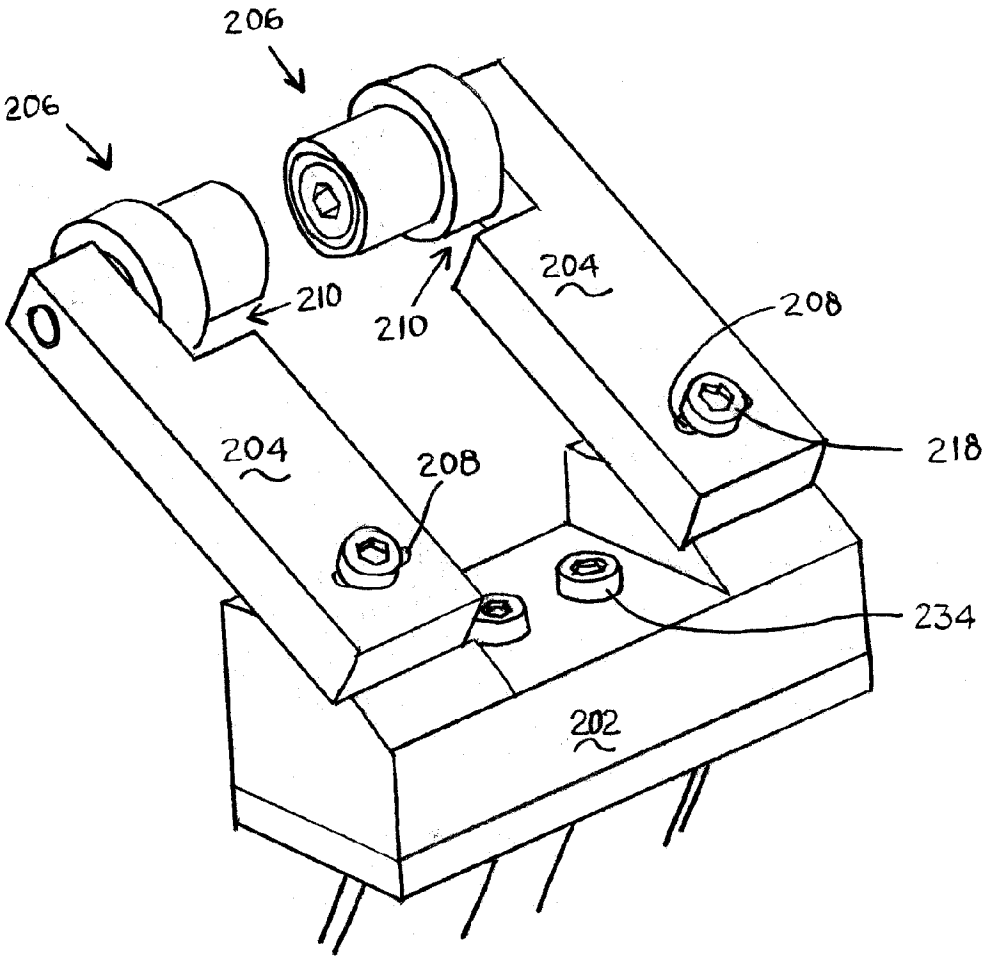
FIG. 11 is a perspective view of a limb outside contact assembly according to the present invention.
Figure 12:
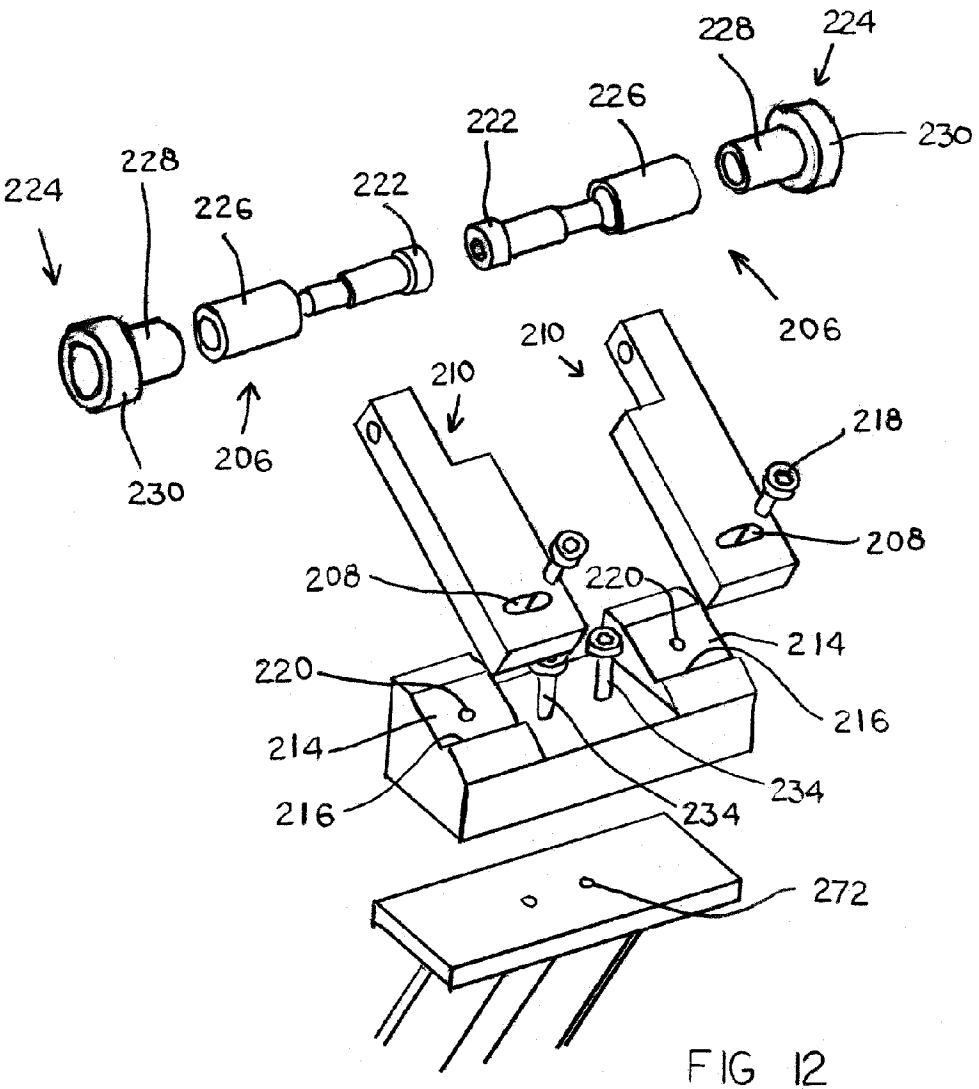
FIG. 12 is a perspective view of a limb outside contact assembly according to the present invention.
Figure 13:
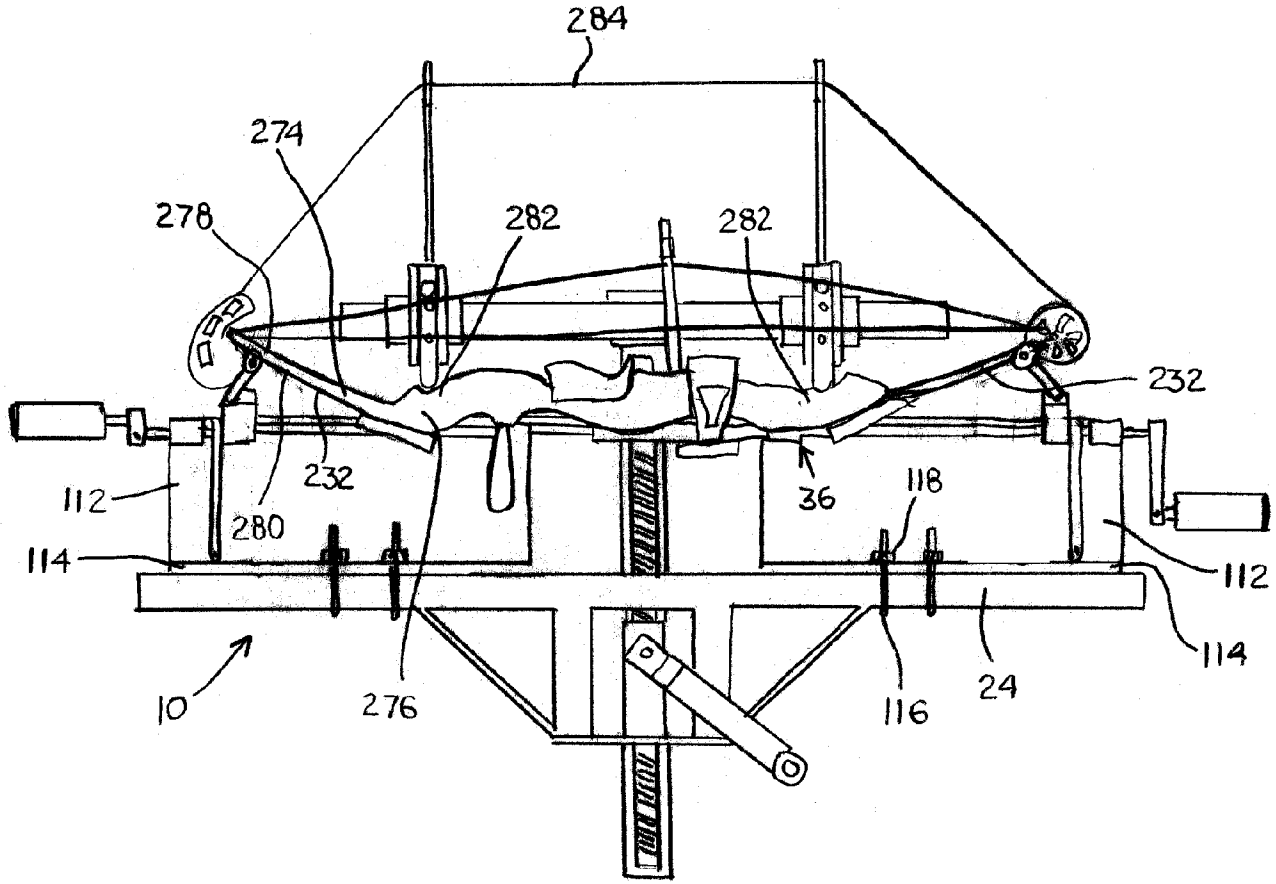
FIG. 13 is a front view of a bow press according to the present invention.
Figure 14:
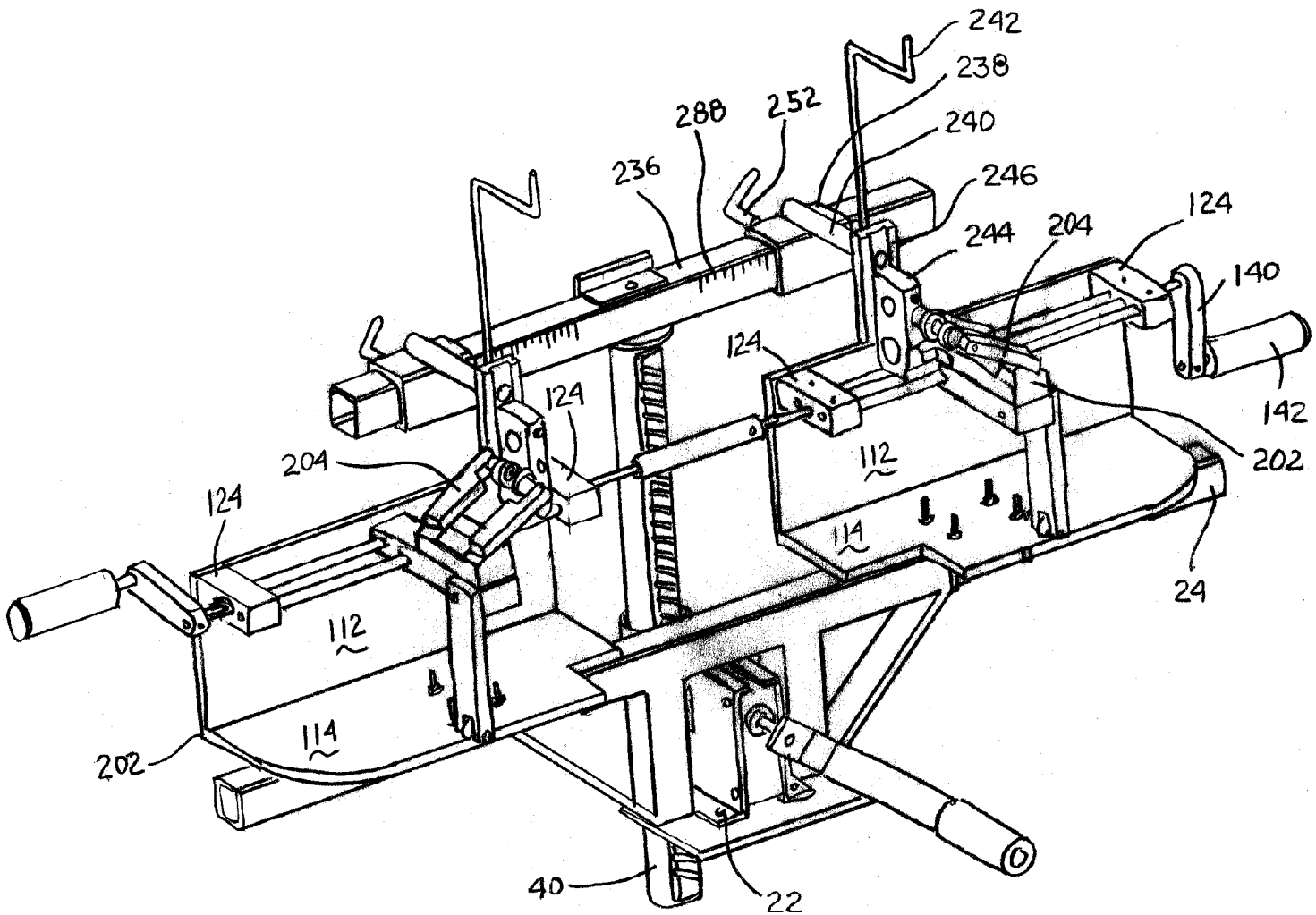
FIG. 14 is a perspective view of a bow press according to the present invention.

The present invention is a bow press 10, as shown in FIGS. 1–18. FIGS. 1, 13–18 show a first embodiment. FIGS. 2–3 and 7–12 show a second embodiment. Both embodiments employ common components, as will be further discussed. Each embodiment employs a stand 12 as shown in FIG. 1 to mount the bow press 10. A table or bench (not shown) can be substituted for the stand 12. Each embodiment includes a main frame 14. The main frame 14 includes a base plate 16 for mounting to the stand 12. The bottom 18 of the base plate 16 is mounted to the stand 12. The base plate 16 is shown with bolt holes 20 in FIG. 15 for mounting to the stand 12 and is mounted with bolts 22 as shown in FIGS. 1–2 and 14. The main frame 14 includes a main frame cross member 24. The main frame cross member 24 is supported above the base plate 16 using two upright supports 28 mounted between a bottom 30 of the main frame cross member 24 and a top 32 of the base plate 16. There are also two angle cross member supports 34 extending from the top 32 of the base plate 16 outward to the bottom 30 of the main frame cross member 24. The main frame cross member 24 is used in both embodiments to support components that will support an archery bow 36, as shown in FIGS. 3 and 13.

Figure 4:
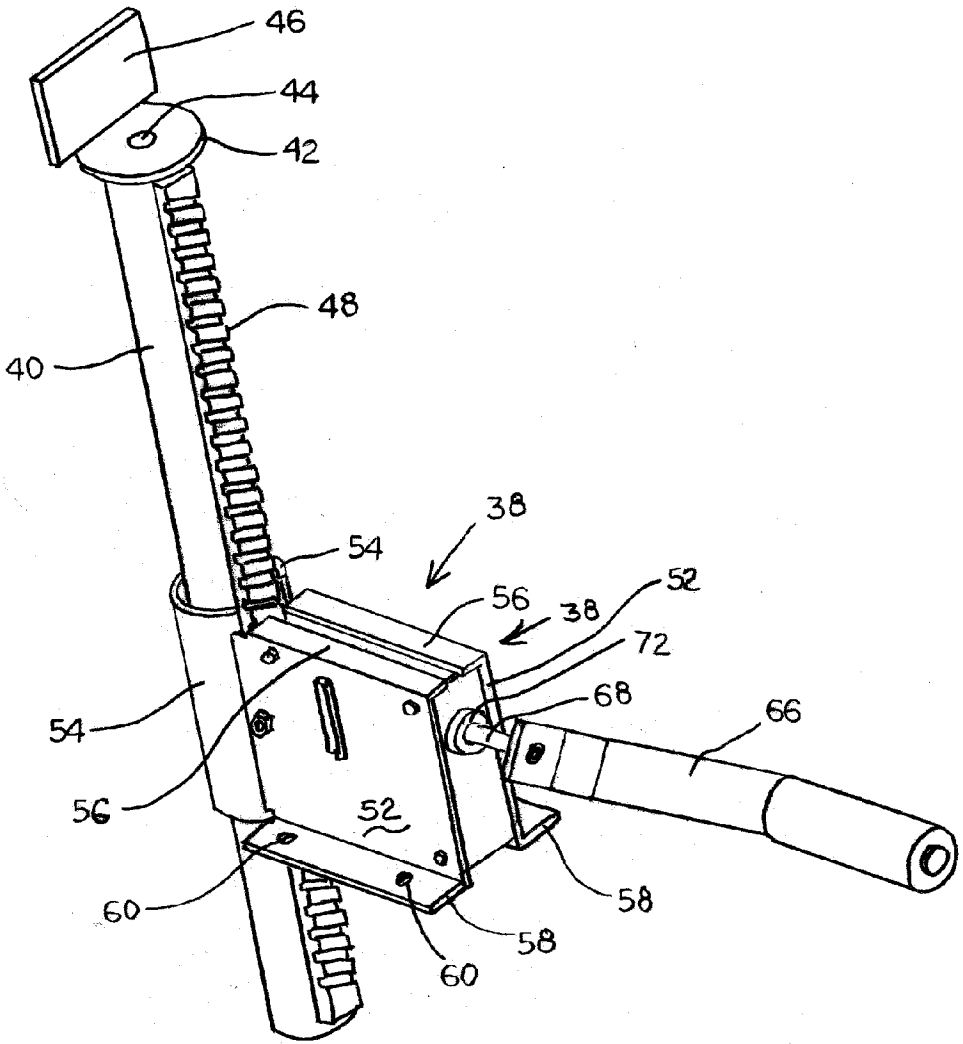
FIG. 4 is a perspective view of an adjustment mechanism according to the present invention.
Figure 5:
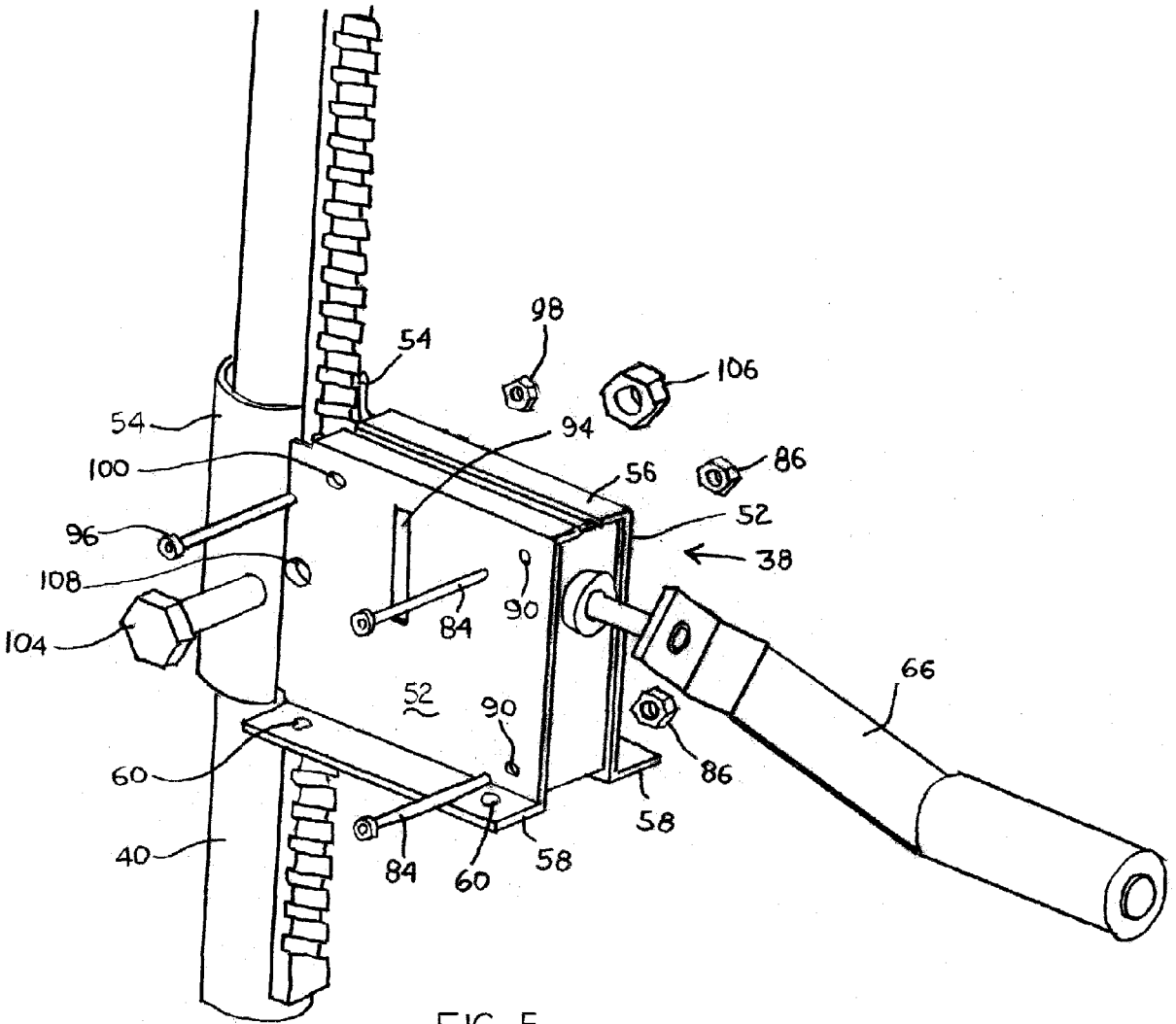
FIG. 5 is a perspective view of an adjustment mechanism according to the present invention.
Figure 6:
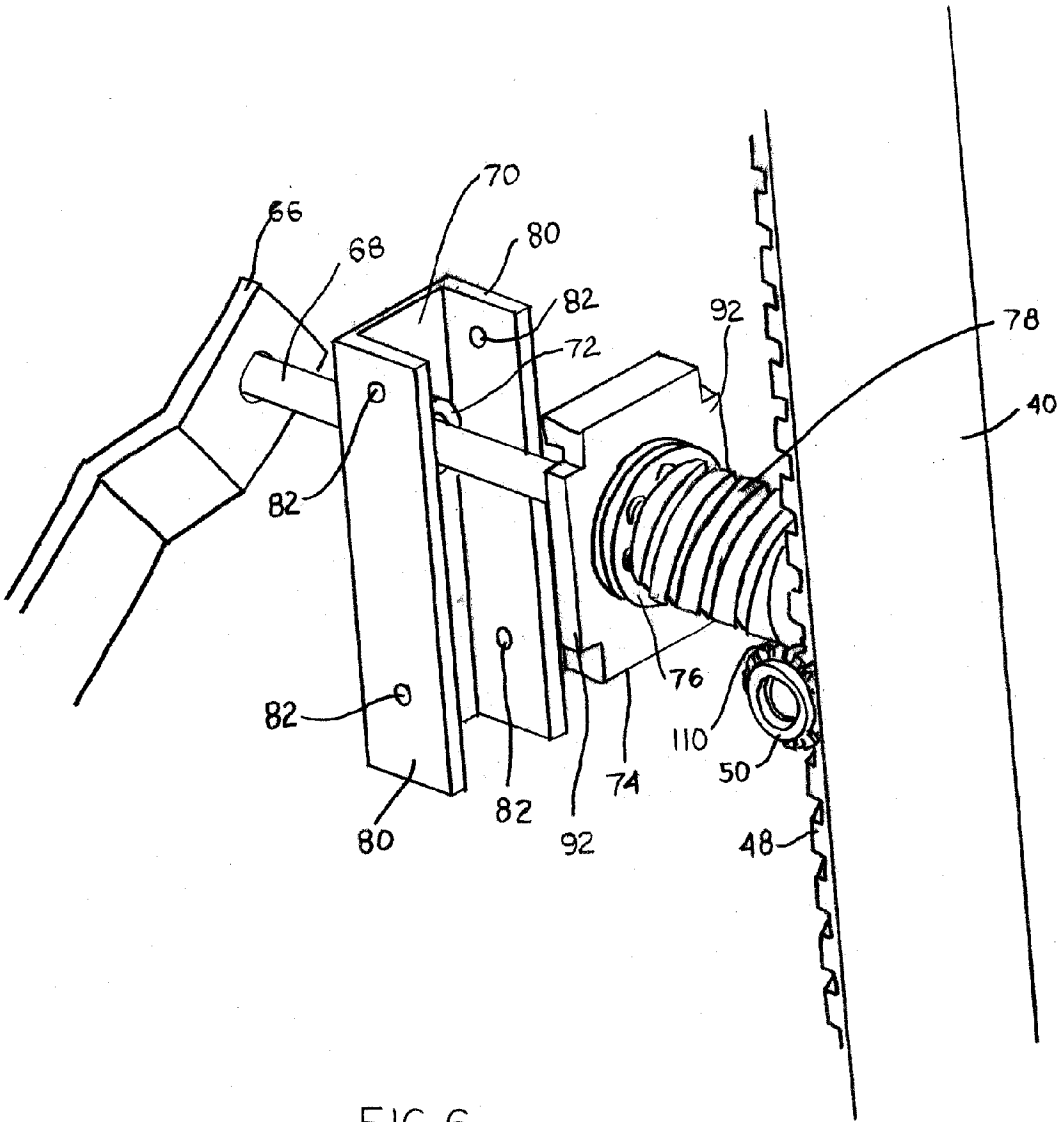
FIG. 6 is a perspective view of an adjustment mechanism according to the present invention.

Both embodiments include an adjustment mechanism mounted to the top 32 of the base plate 16. As shown in FIGS. 4–5, the adjustment mechanism includes a post movement box 38 and post 40 that is moveable. The post 40 includes a top plate 42 with a threaded mounting hole 44. A side support plate 46 extends upward from the top plate 42 of the post 40. The post 40 includes a strip of teeth 48 along the length of the post 40 to interact with a post gear 50, as shown in FIG. 6. The post movement box 38 is mounted between the two upright supports 28 of the main frame 14. The post movement box 38 includes two side plates 52, which act as an enclosure for the post movement box 38. The side plates 52 each include half of a post guide 54, which together form a post guide for the post 40. The side plates 52 of the post movement box 38 each include a cover extension 56 to cover components of the post movement box 38. The side plates 52 of the post movement box 38 each include mounting tabs 58 with bolt holes 60. The post movement box 38 is mounted to the top 32 of the base plate 16 of the main frame 14 using the bolt holes 60 of the mounting tabs 58. The holes 20 of the base plate 16 can be placed to align with the bolt holes 60 of the mounting tabs 58, so that the post movement box 38, base plate 16 and stand 12 are mounted together using the same bolts 22 as shown in FIGS. 1–2 and 14 or other fasteners (not shown).

FIG. 6 shows a crank and gear assembly which is housed by the side plates 52 (not shown). The crank and gear assembly includes a crank handle 66, crank shaft 68, outside crank shaft support 70, outside crank shaft bearing 72, inside crank shaft support 74, inside crank shaft bearing 76, worm gear 78 and the post gear 50. The outside crank shaft support 70 includes two mounting sides 80 with bolt holes 82 in each mounting side 80. The outside crank shaft support 70 is mounted between the two side plates 52 using bolts 84 and nuts 86, bolt holes 82 and bolt holes 90 of the side plate 52. The outside crank shaft bearing 72 is mounted on the outside crank shaft support 70 to support the crank shaft 68. The inside crank shaft support 74 includes two tabs 92 which fit into slots 94 of the slide plates 52. The inside crank shaft support 74 is sandwiched between the side plates 52 such that the tabs 92 engage the slots 94 of the side plates 52. An additional bolt 96, nut 98 and bolt hole 100 are used to squeeze the side plates 52 together and secure the inside crank shaft support 74. The inside crank shaft bearing 76 is mounted on the inside crank shaft support 74 to support the crank shaft 68. The worm gear 78 is mounted on the end of the crank shaft 68 which is closest to the post 40. The crank handle 66 is mounted on the end of the crank shaft 68 furthest from the post 40. The post gear 50 is mounted in the post movement box 38 by using the bolt 104, nut 106 and bolt holes 108 in the side plates 52. The bolt 104 acts as a shaft for the post gear 50. The worm gear 78 engages teeth 110 of the post gear 50. The teeth 110 of the post gear 50 engages the strip of teeth 48 of the post 40 and together move the post 40 and hold the post 40 in position in relation to the post movement box 38.

The first embodiment is shown in FIG. 1 attached to the stand. FIGS. 13–14 show a closer view of the first embodiment without the stand 12. FIG. 13 shows the first embodiment with the archery bow 36 secured to the bow press 10. The first embodiment includes a bow limb flexing assembly, bow limb flexing assembly supports and limb inside contact assembly. The bow limb flexing assembly supports are shown as angled plates having a vertical plate 112 and a horizontal plate 114. The bow limb flexing assembly supports are attached to the main frame cross member 24 of the main frame 14 using U-bolts 116 and nuts 118. The positioning of the bow limb flexing assembly supports along the main frame cross member 24 can be easily adjusted by slightly loosening the nuts 118 and sliding the bow limb flexing assembly supports with the U-bolts 116 along the length of the main frame cross member 24. The bow limb flexing assembly supports are shown with cut outs to allow room for rotating the crank handle 66 of the post movement box 38, as shown in FIG. 14.

Figure 15:
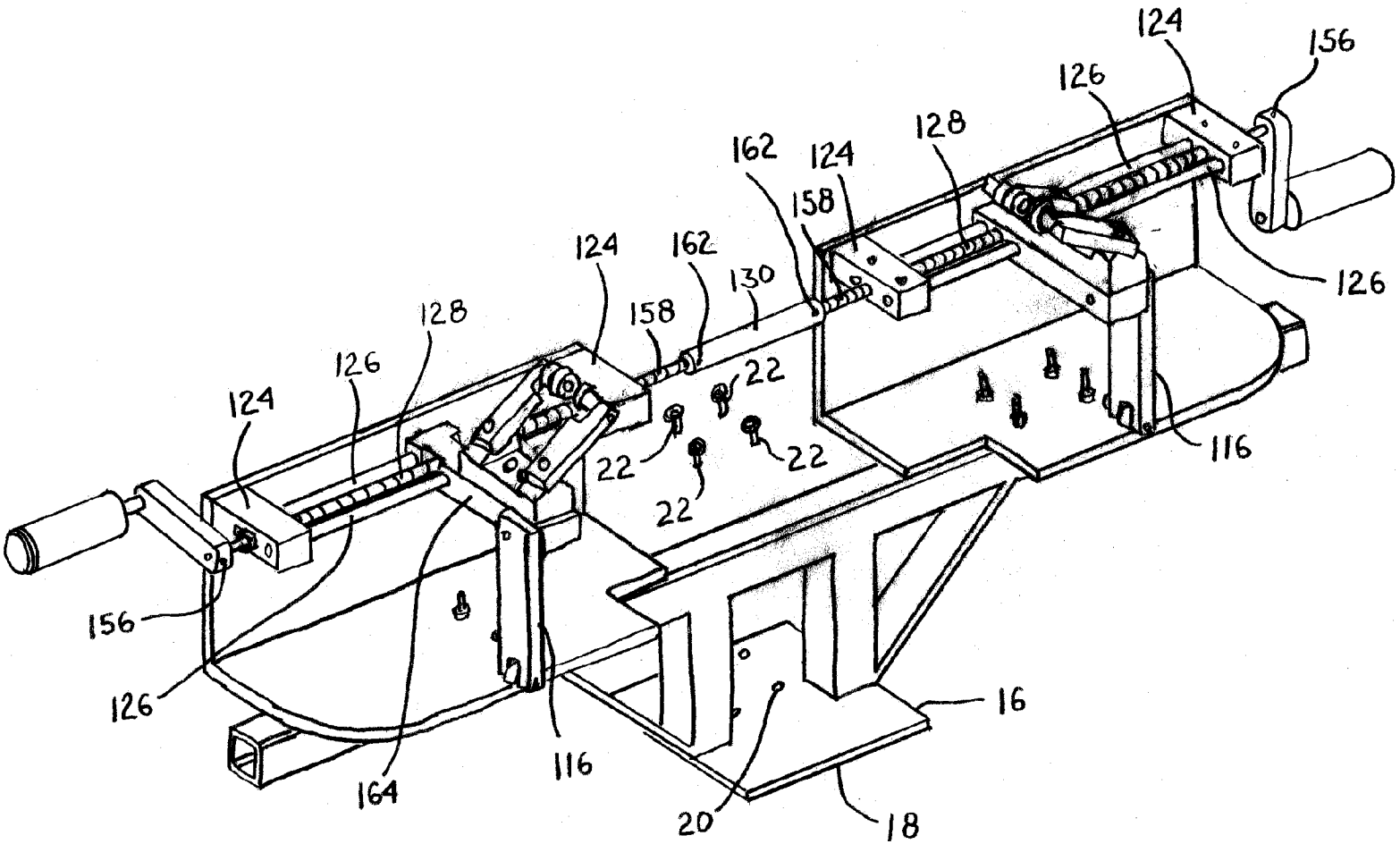
FIG. 15 is a perspective view of a limb support drive assembly according to the present invention.
Figure 16:
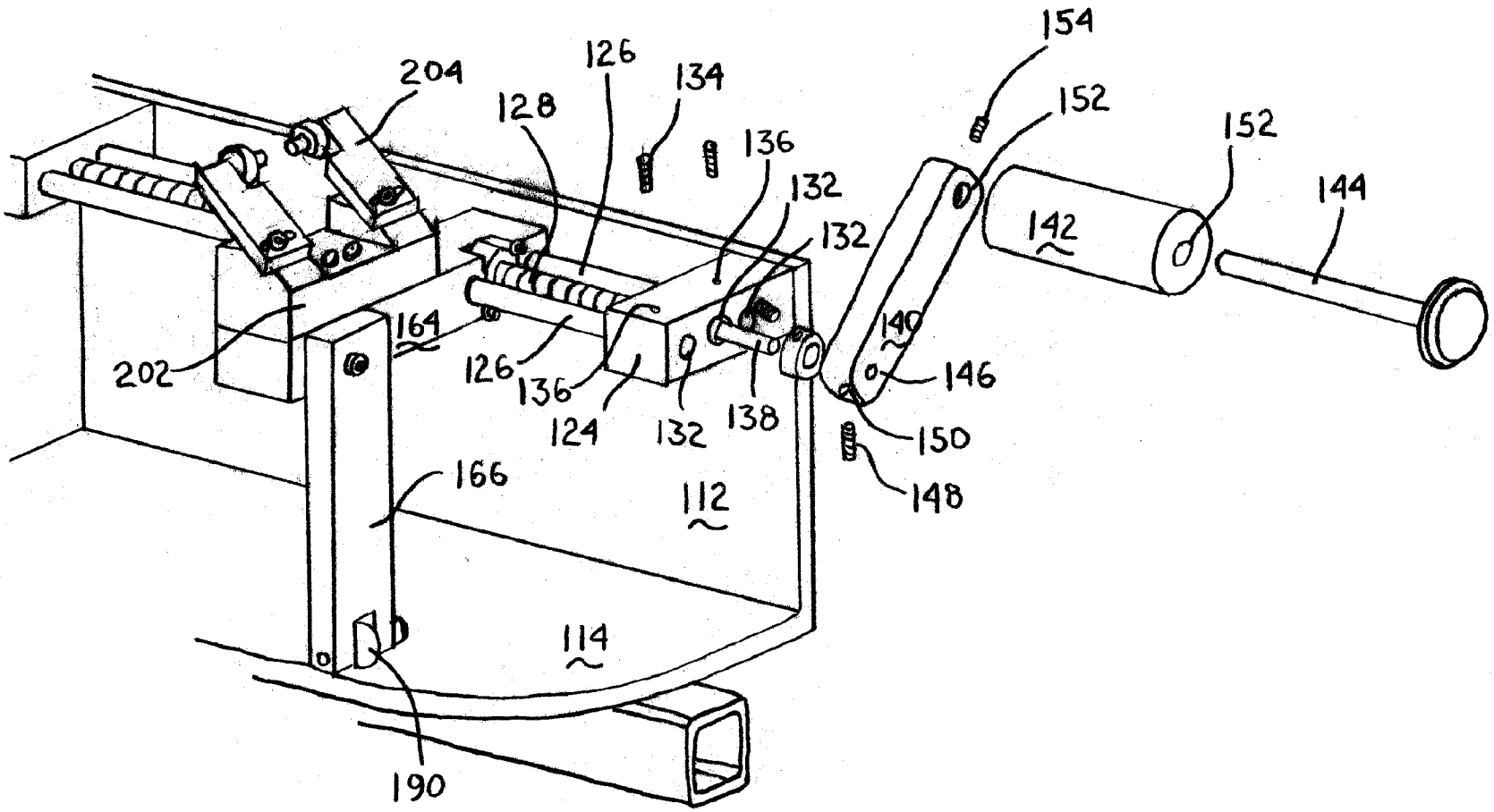
FIG. 16 is a perspective view of a limb support drive assembly according to the present invention.

The bow limb flexing assembly includes two limb support assemblies and a limb support drive assembly, as shown in FIG. 15. The limb support drive assembly is used to move the limb support assemblies, as well as provide some support for the limb support assemblies. The limb support drive assembly includes four drive supports 124, four support rods 126, two screw rods 128, coupler 130 and two adjustment handle assemblies. Two of the drive supports 124 are secured to the vertical plate 112 of one of the bow limb flexing assembly supports and the other two drive supports 124 are secured to the vertical plate 112 of the other flexing assembly support. Each drive support 124 includes three holes 132 in a line, as shown in FIG. 16. At each flexing assembly support, two of the support rods 126 are inserted into the outside holes of and between the drive supports 124. The support rods 126 are secured in the drive supports 124 using set screws 134 and set screw holes 136. At each flexing assembly support, one of the screw rods 128 passes through the middle hole of the drive supports 124. Each screw rod 128 can rotate freely inside of the middle holes. Each screw rod 128 includes an crank attachment end 138 to receive an adjustment handle assembly. One of the adjustment handle assemblies is shown in FIG. 15 with a crank arm 140, handle 142 and handle pin 144. Even though two adjustment handle assemblies are shown, only one is needed. The crank arm 140 is secured to the crank attachment end 138 using crank attachment end hole 146, a set screw 148 and set screw hole 150. The handle 142 is secured to the crank arm 140 using the handle pin 144, handle holes 152, set screw 154 and set screw hole 156. The screw rods 128 each include a coupler end 158 that extends out towards the middle of the main frame cross member 24 and towards each other. The coupler 130 couples the screw rods 128 together at the coupler end 158 of each screw rod 128 using set screws 162. Whereby, rotation of one screw rod 128 causes the other screw rod 128 to rotate.

Figure 17:
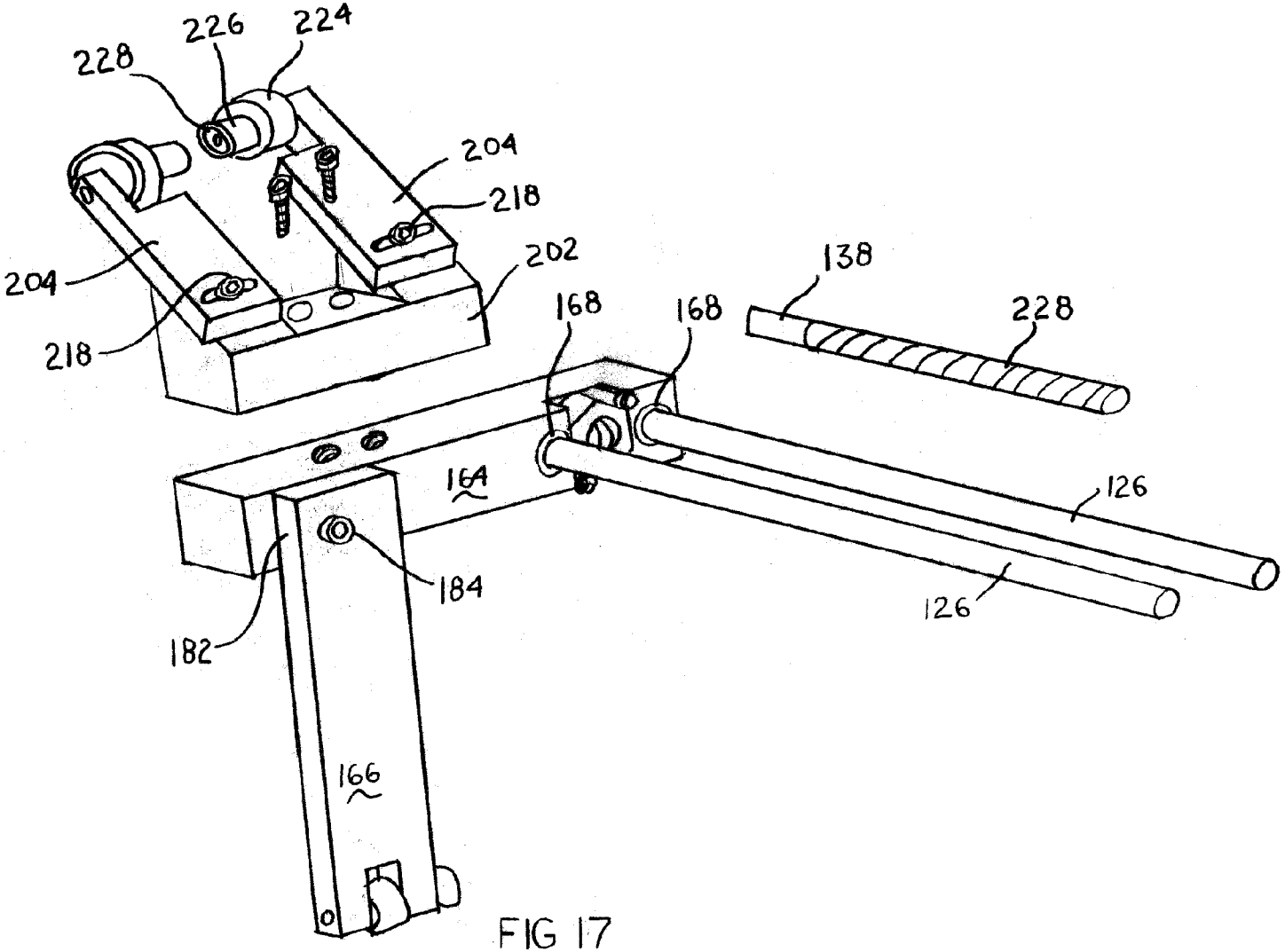
FIG. 17 is a perspective view of a limb support drive assembly according to the present invention.
Figure 18:
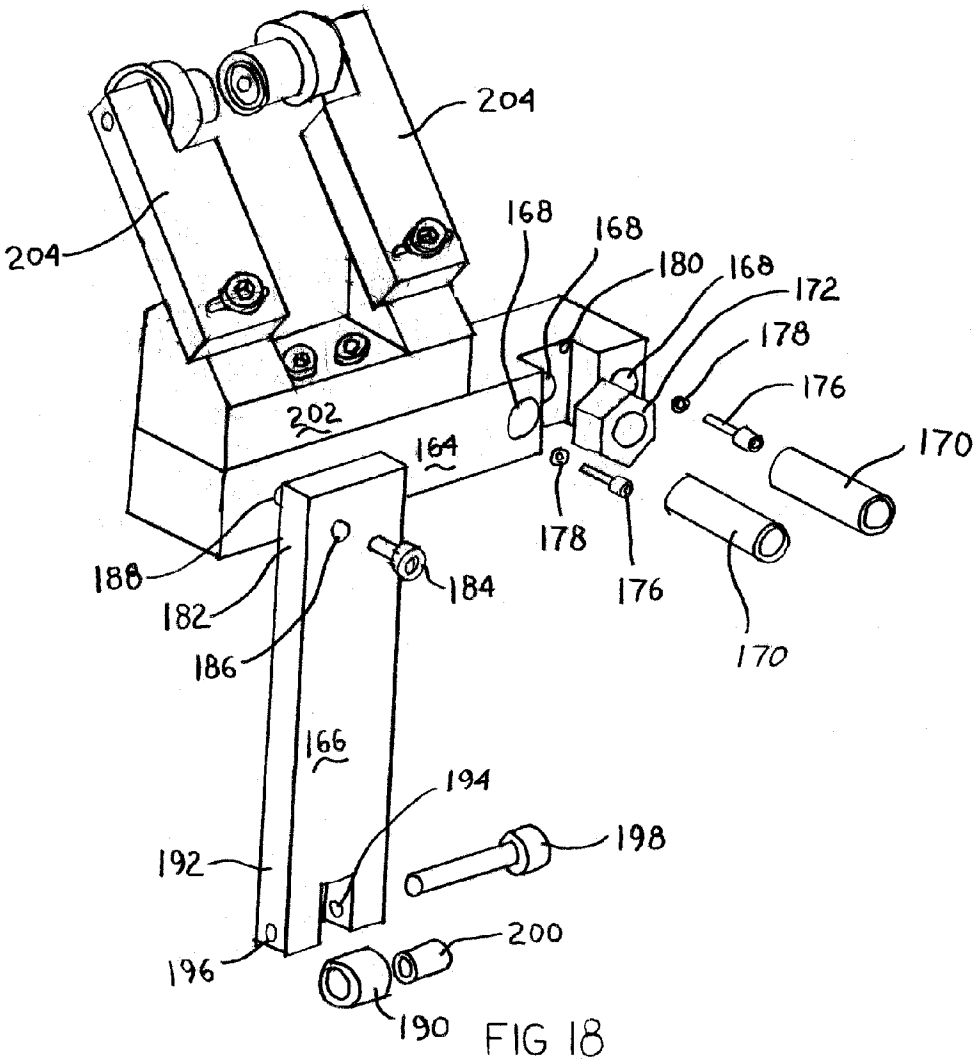
FIG. 18 is a perspective view of a limb support drive assembly according to the present invention.

The limb support assemblies are shown in more detail in FIGS. 16–18. Each limb support assembly includes horizontal support 164 and a vertical support 166. The horizontal support 164 includes three holes 168 on one end of the horizontal support 164. The two outside holes include bushings 170 pressure fitted into the holes 168. There is a cut out in the horizontal support 164 about the middle hole 168. A nut 172 is mounted in the cut out using screws 176, washers 178 and threaded holes 180. The horizontal support 164 is mounted to the limb support drive assembly between the two drive supports 124 before the drive supports 124 are secured to the vertical plate 112 of the bow limb flexing assembly supports. The horizontal support 164 is mounted by inserting the support rods 126 through the bushings 170 in outside holes of the horizontal support 164, where the open diameter of the bushings 170 is larger than the diameter of the support rods 126. The horizontal support 164 slides along the support rods 126. Each screw rod 128 is threaded between each nut 172 of its respective assembly. The screw rods 128 and nuts 172 should be threaded correctly, such that by turning either adjustment handle assemblies, the screw rods 128 move the horizontal supports 164 towards each other and away from each other along the support rods 126, depending on what direction the adjustment handle assembly is rotated. A top 182 of the vertical support 166 of the limb support assemblies is mounted to the horizontal support 164 of the limb support assemblies using a screw 184, hole 186 in the vertical support 166 and threaded hole 188 in the horizontal support 164. A roller 190 is installed in a cut out at a bottom 192 of the vertical support 166. The bottom 192 of the vertical support 166 includes hole 194 and threaded hole 196 to receive a roller axle screw 198. The roller 190 includes a bushing 200 which fits into the roller 190 and over the roller axle screw 198. The vertical support 166 and roller 190 are positioned such the roller 190 contacts and rolls along the horizontal plate 114 of the bow limb flexing assembly supports to provide a movable support to the limb support assemblies.

Figure 10:
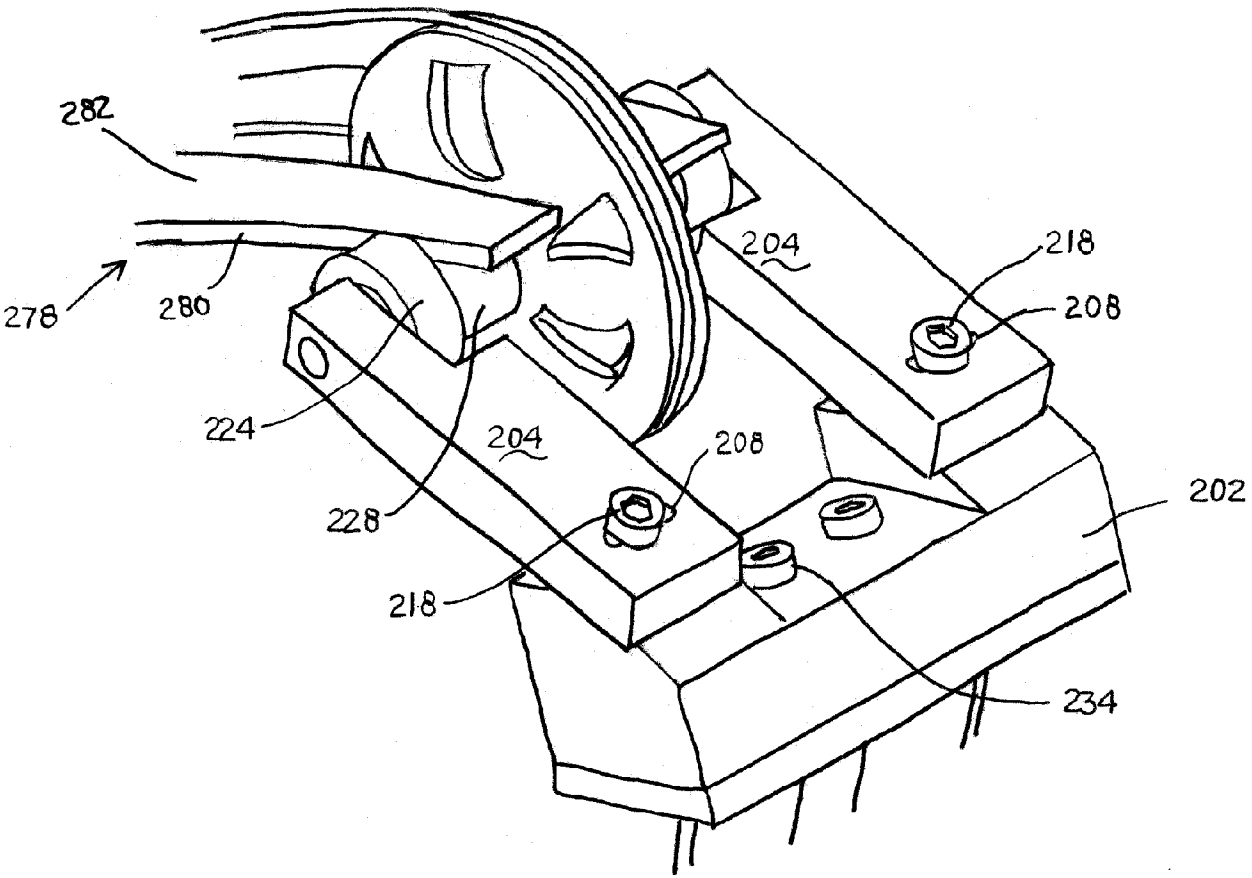
FIG. 10 is a perspective view of a limb outside contact assembly according to the present invention.

Both embodiments employ limb outside contact assemblies and the limb inside contact assembly. The limb outside contact assemblies are shown mounted to the horizontal support 164 of the limb support assemblies shown in FIGS. 13–18. FIGS. 11–12 show a closer views of a limb outside contact assembly. The limb outside contact assembly includes a base 202, two arms 204 and two limb rollers 206. The arms 204 each include a slot 208, roller cut out 210 and threaded hole 212 in the roller cut out 210. The base 202 includes an angled arm mounting area 214 for each arm 204 to position the arms 204 at an angle towards the archery bow 36 and offset the limb rollers 206 from the base 202. The angled arm mounting areas 214 includes a cut-out shoulder 216, as shown in FIG. 12. The arms 204 are mounted to the base 202 using screws 218, the slots 208 and threaded holes 220 in the angled arm mounting area 214. The slots 208 in the arm 204 allow adjustment of the arms 204 on the base 202. The limb rollers 206 each include a screw 222, guide roller 224 and nylon limb protector 226. The guide roller 224 includes an open cylinder 228 with a guide end 230. The nylon limb protector 226 fits over the open cylinder 228. The limb roller 206 is mounted by inserting the screw 222 into the open cylinder 228 and screwing the screw 222 into the threaded hole 212 in the roller cut out 210 of the arm 204, such that the guide end 230 is against the roller cut out 210 of the arm 204. The nylon limb protector 226 protects the limb 232 of the archery bow 36. The guide end 230 acts as a stop against the arm 204 and as a guide for the bow limbs 232 of the archery bow 36, as shown in FIG. 10. The limb outside contact assemblies are mounted to the horizontal support 164 of each limb support assembly using screws 234.

FIGS. 1–3, 8–9 and 13–14 show the limb inside contact assembly used in both embodiments. The limb inside contact assembly include a cross member 236 and two contact assemblies. The contact assemblies each include a sliding support 238, support arm 240, bow string support 242, limb contact 244 and limb contact support 246. The cross member 236 includes a mounting hole 248 to mount the cross member 236 to the top plate 42 of the post 40 using a screw 250 and the threaded mounting hole 44 of the top plate 42 of the post 40. The side support plate 46 of the post 40 provides support for the cross member 236 of the limb inside contact assembly. The cross member 236 and sliding supports 238 are made such that the sliding supports 238 slide over and slide along the cross member 236. The cross member 236 and sliding supports 238 are shown as an open square tube shape. The sliding supports 238 include a locking device which includes a set screw 252 with a handle 254 and a threaded hole 256 in the sliding supports 238. The set screw 252 is turned against the cross member 236 to lock the sliding supports 238 in place along the cross member 236. One end of the support arms 240 are attached to the sliding supports 238 and extend outward. The limb contact support 246 is attached to the other end of the support arm 240. The limb contacts 244 are attached to limb contact supports 246. The limb contacts 244 can be made of a no-marring material or have a no-marring material glued or attached to the limb contacts 244 at the contact section 258 of the limb contacts 244. The contact section 258 is rounded to allow for movement of the bow limb 232 during contact between the limb contact 244 and the bow limb 232. Each support arm 240 includes a hole 260 to receive the bow string support 242 and set screw 262 to secure the bow string support 242.

Figure 7:
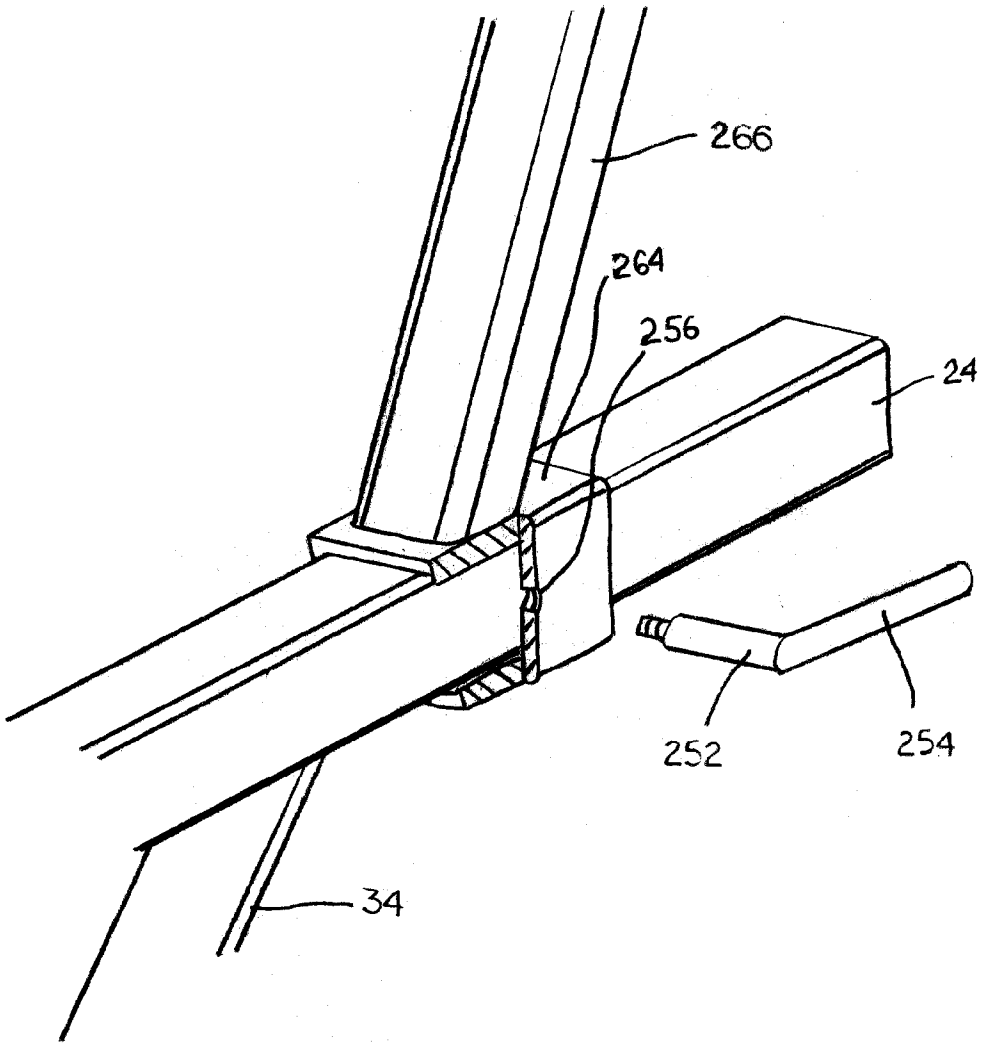
FIG. 7 is a perspective view of a sliding support according to the present invention.
Figure 8:
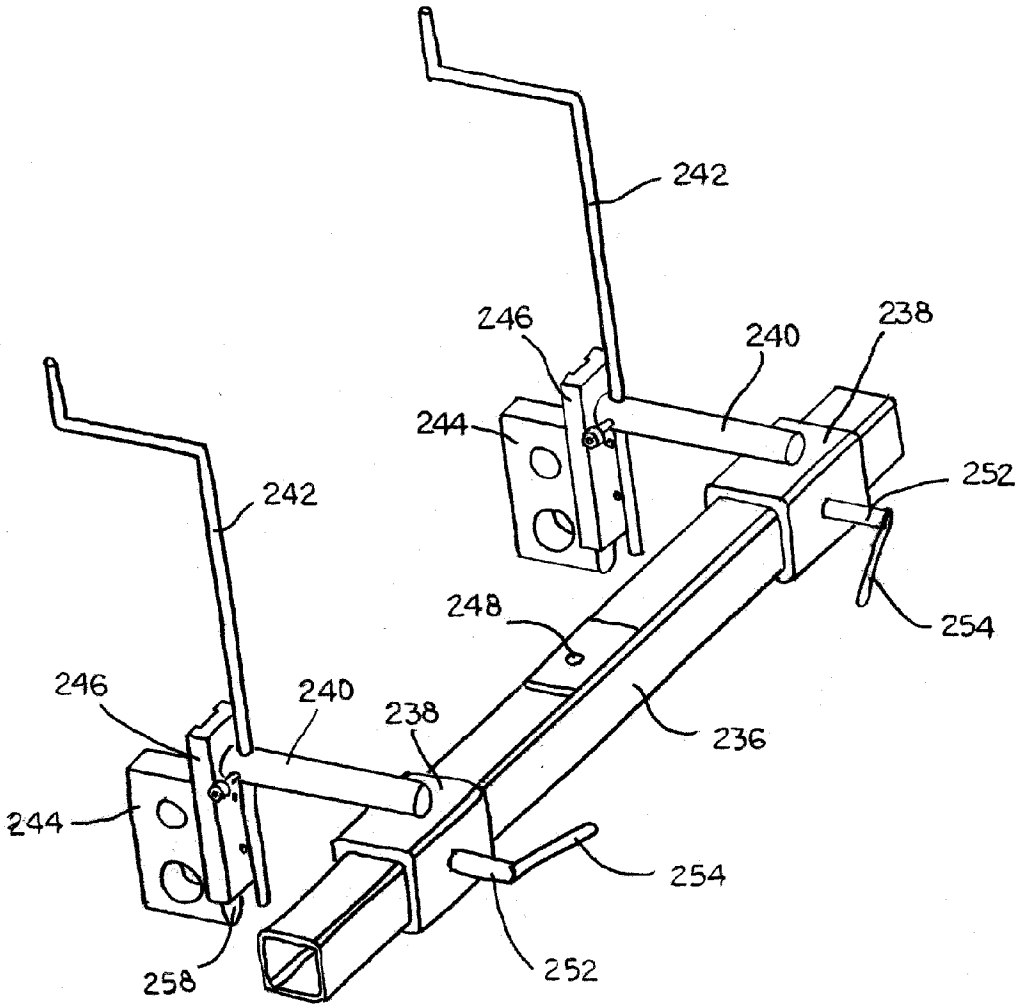
FIG. 8 is a perspective view of a limb inside contact assembly according to the present invention.
Figure 9:
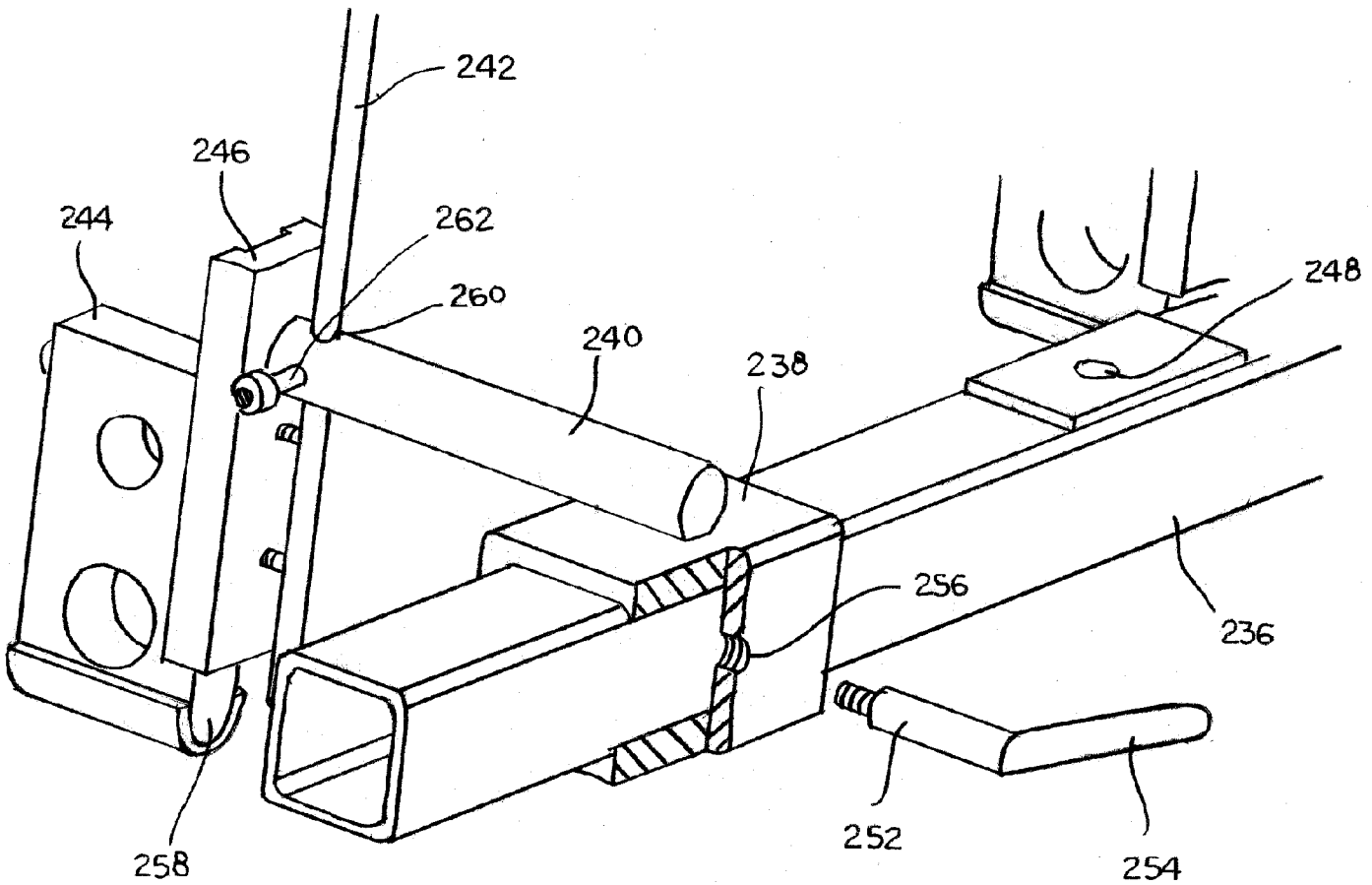
FIG. 9 is a perspective view of a limb inside contact assembly according to the present invention.

The second embodiment is shown in FIG. 2–3 attached to the stand 12. The second embodiment replaces the two limb support assemblies and a limb support drive assembly of the bow limb flexing assembly with a different limb support assembly. The limb support assembly of the second embodiment includes a sliding support 264 and a support arm 266. The sliding supports 264 are made such that the sliding supports 264 slide over and slide along the main frame cross member 24 of the main frame 14. The main frame cross member 24 and sliding supports 264 are shown as an open square tube shape. The sliding supports 264 include a locking device which includes a set screw 252 with a handle 254 and a threaded hole 256 in the sliding supports 264, as shown in FIG. 7. The set screw 252 is turned against the main frame cross member 24 to lock the sliding supports 264 in place along the main frame cross member 24. The support arm 266 is attached to and extends upward from the sliding support 264. The support arm 266 includes a top plate 268 as shown in FIGS. 2 and 11–12 to receive the limb outside contact assembly, which is the same as shown for the first embodiment. The limb outside contact assembly is mounted to the top plate 268 using screw 234 and threaded screw holes 272.

The archery bow 36 is shown in the bow press in FIG. 13 for the first embodiment and FIG. 3 for the second embodiment. The limbs 232 of the archery bow 36 each have a riser end 274 attached to the riser 276 of the archery bow 36 and a free end 278 opposite the riser end 274. The outside surface 280 of the bow limbs 232 near the free end 278 rest on the limb rollers 206 of the limb outside contact assembly, as shown in FIGS. 3, 10 and 13. In order for the outside surface 280 of the bow limbs 232 to rest on the limb rollers 206, each limb outside contact assembly must be adjusted to fit under the archery bow 36. In the case of the first embodiment, one of the handles 142 of the limb support drive assembly must be rotated to move the two limb support assemblies either towards or away from each other, so that the outside surface 280 of the bow limbs 232 rest on the limb rollers 206 of the limb support assemblies. Then, crank handle 66 of the adjustment mechanism is rotated to move the limb contacts 244 of the two contact assemblies downward against an inside surface 282 of the bow limbs 232 or the riser 276 of the archery bow 36, as shown in FIG. 13. When the limb contacts 244 press down on the riser 276, the archery bow 36 flexes due to the contact between the outside surface 280 of the bow limbs 232 and the limb rollers 206. During flexing, the archer bow 36 is flexed until the limb rollers 206 are positioned near the free end 278 of the bow limbs 232. Whereby, the bow limbs 232 move along the limb rollers 206 during flexing of the archer bow 36. This reduces the tension on a bow string 284 of the archer bow 36 and allows servicing of the archery bow 36. Also, in the first embodiment, the flexing of the bow limbs 232 can be controlled by movement of one of the handles 142 of the limb support drive assembly which moves the two limb support assemblies, once the two contact assemblies are against the inside surface 282 of the bow limbs 232 or the riser 276 of the archery bow 36.

The bow string 284 is usually placed on the bow string supports 242 after flexing to hold the bow string 284 in a position which is out of the way of the user of the bow press 10. In the case of the second embodiment, the two limb support assemblies are moved by moving the sliding support 264 along the main frame cross member 24 to the proper position. For maximum lineage, the two limb support assemblies should be positioned such that the limb rollers 206 are as closed to the free end 278 of the bow limbs 232 as possible. The flexing of the archery bow 36 is accomplished in the same manner as described for the first embodiment with the movement of the limb contacts 244. FIGS. 14 and 2 show an indexing scale 288 along the cross member 236 of the limb inside contact assemblies for both embodiments. FIG. 2 shows an indexing scale 288 along the main frame cross member 24 for second embodiment, but are also placed on the first embodiment as well. The indexing scales 288 allow accurate positioning of an archery bow 36 ever time the same archery bow 36 is placed on the bow press 10.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A bow press for securing an archery bow having limbs, comprising:

a main frame to support other components of said bow press;

an adjustment mechanism mounted to said main frame;

a bow limb flexing assembly mounted to said main frame adapted for receiving the archery bow, said bow limb flexing assembly including two bow flexing assembly supports mounted to said main frame, said bow limb flexing assembly including a limb support assembly mounted to each of said two bow limb flexing assembly supports which are adapted to receive and support the archery bow, and said bow limb flexing assembly including a limb support drive assembly mounted to said two bow limb flexing supports to move said limb support assemblies toward and away from each other; and a limb inside contact assembly adapted to secure the archer bow against said bow limb flexing assembly and mounted to said adjustment mechanism, whereby said limb inside contact assembly can be moved to due to actuation of said adjustment mechanism.

2. The bow press of claim 1, wherein said main frame includes a main frame cross member; and wherein said two bow limb flexing assembly supports are mounted to said main frame cross member.

3. The bow press of claim 1, wherein said limb support drive assembly includes a set of two drive supports mounted to each of said two bow limb flexing assembly supports, wherein each of said drive supports includes three holes; wherein said limb support drive assembly includes two support rods which are secured in two of said three holes of each set of said drive supports and a screw rod that is allowed to rotate and retained by a third hole of said three holes of each set of said drive supports; and wherein one of said two limb support assemblies is mounted between each of said set of two drive supports and attached to said screw rod such that rotation of said screw rods move said limb support assembly between said set of two drive supports.

4. The bow press of claim 3, wherein said screw rod of each of said set of two drive supports are coupled together, such that said screw rods rotate together.

5. The bow press of claim 4, wherein there is at least one handle attached to one of said screw rods to rotate said screw rods and move said limb support assemblies.

6. The bow press of claim 3, wherein each of said limb support assemblies includes horizontal support and a vertical support; wherein said horizontal support includes three horizontal support holes on one end of said horizontal support; wherein two of said three horizontal support holes allow said support rods of said limb support drive assembly to pass and an other hole of said three horizontal support holes is threaded and receives said screw rod of said limb support drive assembly, whereby rotation of said screw rod within said other hole of said three horizontal support holes moves said horizontal support along said support rods; and wherein said vertical support extends downward from said horizontal support; and wherein said vertical support includes a roller to contact a support surface.

7. The bow press of claim 6, wherein said screw rod of each of said set of two drive supports are coupled together, such that said screw rods rotate together.

8. The bow press of claim 7, wherein there is at least one handle attached to one of said screw rods to rotate said screw rods and move said limb support assemblies.

9. The bow press of claim 7, wherein said limb support assemblies each include an limb outside contact assembly; wherein said limb outside contact assembly includes a base, two arms and two limb rollers; wherein said two arms extend from said base and are adapted to receive one of the limbs of the archery bow; and wherein one of said two limb rollers are attached to each of said arms and are adapted to contact one of the limbs of the archery bow.

10. The bow press of claim 3, wherein said limb support assemblies each include an limb outside contact assembly; wherein said limb outside contact assembly includes a base, two arms and two limb rollers; wherein said two arms extend from said base and are adapted to receive one of the limbs of the archery bow; and wherein one of said two limb rollers are attached to each of said arms and are adapted to contact one of the limbs of the archery bow.

11. The bow press of claim 1, wherein said limb support assemblies each include an limb outside contact assembly; wherein said limb outside contact assembly includes a base, two arms and two limb rollers; wherein said two arms extend from said base and are adapted to receive one of the limbs of the archery bow; and wherein one of said two limb rollers are attached to each of said arms and are adapted to contact one of the limbs of the archery bow.

12. The bow press of claim 1, wherein said limb inside contact assembly includes an inside contact assembly cross member attached to said adjustment mechanism; and wherein said limb inside contact assembly includes two contact assemblies extending from said inside contact assembly cross member and adapted to contact the archery bow and secure the archery bow in said bow press.

13. The bow press of claim 12, wherein said contact assemblies each include a support movable along said inside contact assembly cross member for attachment of said contact assemblies to said inside contact assembly cross member.

14. The bow press of claim 1, further including a bow string support mounted to said limb inside contact assembly, said bow string support adapted to contact and support a bow string of the archery bow away from the archery bow during flexing of the archery bow.

15. A bow press for securing an archery bow having limbs, comprising:

a main frame to support other components of said bow press, said main frame including a main frame cross member;

an adjustment mechanism mounted to said main frame;

a bow limb flexing assembly mounted to said main frame cross member adapted for receiving the archery bow;

a limb inside contact assembly adapted to secure the archer bow against said bow limb flexing assembly and mounted to said adjustment mechanism, whereby said limb inside contact assembly can be moved to due to actuation of said adjustment mechanism;

wherein said bow limb flexing assembly includes two bow limb flexing assembly supports mounted to said main frame cross member; wherein each of said two bow limb flexing assembly supports include a sliding support, a support arm extending from said sliding support and limb outside contact assembly mounted to said support arm such that said limb outside contact assemblies are adapted to contact the limbs of the archery bow; and wherein said sliding support of each of said two bow limb flexing assembly supports is movably attached to said main frame cross member; and wherein each of said limb outside contact assemblies include a base, two arms and two limb rollers; wherein said two arms extend from said base and are adapted to receive one of the limbs of the archery bow; and wherein one of said two limb rollers are attached to each of said arms and are adapted to contact one of the limbs of the archery bow.

16. The bow press of claim 15, wherein said adjustment mechanism includes a post movement box; and wherein said adjustment mechanism includes a post attached to said limb inside contact assembly which is movably attached to said post movement box to allow movement of said limb inside contact assembly.

17. The bow press of claim 15, further including a bow string support mounted to said limb inside contact assembly, said bow string support adapted to contact and support a bow string of the archery bow away from the archery bow during flexing of the archery bow.

18. A bow press for securing an archery bow having limbs, comprising:

a main frame to support other components of said bow press, said main frame including a main frame cross member;

an adjustment mechanism mounted to said main frame;

a bow limb flexing assembly mounted to said main frame cross member adapted for receiving the archery bow;

a limb inside contact assembly adapted to secure the archer bow against said bow limb flexing assembly and mounted to said adjustment mechanism, whereby said limb inside contact assembly can be moved to due to actuation of said adjustment mechanism;

wherein said bow limb flexing assembly includes two bow limb flexing assembly supports mounted to said main frame cross member; wherein each of said two bow limb flexing assembly supports include a sliding support, a support arm extending from said sliding support and limb outside contact assembly mounted to said support arm such that said limb outside contact assemblies are adapted to contact the limbs of the archery bow; and wherein said sliding support of each of said two bow limb flexing assembly supports is movably attached to said main frame cross member; and wherein said limb inside contact assembly includes an inside contact assembly cross member attached to said adjustment mechanism; and wherein said limb inside contact assembly includes two contact assemblies extending from said inside contact assembly cross member and adapted to contact the archery bow and secure the archery bow in said bow press and wherein said contact assemblies each include a support which slides along said inside contact assembly cross member for attachment of said contact assemblies to said inside contact assembly cross member and said support having a quick secure mechanism for securing said support in position along said inside contact assembly cross member.

19. The bow press of claim 18, wherein said limb support assemblies each include an limb outside contact assembly; wherein said limb outside contact assembly includes a base, two arms and two limb rollers; wherein said two arms extend from said base and are adapted to receive one of the limbs of the archery bow; and wherein one of said two limb rollers are attached to each of said arms and are adapted to contact one of the limbs of the archery bow.

20. The bow press of claim 18, further including a bow string support mounted to said limb inside contact assembly, said bow string support adapted to contact and support a bow string of the archery bow away from the archery bow during flexing of the archery bow.

21. A bow press for securing an archery bow having limbs, comprising:

a main frame to support other components of said bow press;

a bow limb flexing assembly mounted to said main frame adapted for receiving the archery bow, said bow limb flexing assembly including two bow limb flexing assembly supports mounted to said main frame, said bow limb flexing assembly including a limb support assembly mounted to each of said two bow limb flexing assembly supports which are adapted to receive and support the archery bow, and said bow limb flexing assembly including a limb support drive assembly mounted to said two bow limb flexing supports to move said limb support assemblies toward and away from each other; and said limb support assemblies each include a limb outside contact assembly; wherein said limb outside contact assembly includes a base, two arms and two limb rollers; wherein said two arms extend from said base and are adapted to receive one of the limbs of the archery bow; and wherein one of said tow limb rollers are attached to each of said arms and are adapted to contact one of the limbs of the archery bow.

22. The bow press of claim 21, further including a bow string support mounted to said main frame, said bow string support adapted to contact and support a bow string of the archery bow away from the archery bow during flexing of the archery bow.

23. A bow press for securing an archery bow having limbs, comprising:

a main frame to support other components of said bow press;

a bow limb flexing assembly mounted to said main frame adapted for receiving and flexing the archery bow, said bow limb flexing assembly including two limb outside contact assemblies adapted to contact the limbs of the archery bow, said limb outside contact assemblies each including a base, two arms and two limb rollers; wherein said two arms extend from said base and are adapted to receive one of the limbs of the archery bow; and wherein one of said two limb rollers are attached to each of said arms and are adapted to contact one of the limbs of the archery bow.

24. The bow press of claim 23, further including a bow string support mounted to said main frame, said bow string support adapted to contact and support a bow string of the archery bow away from the archery bow during flexing of the archery bow.

25. A bow press for securing an archery bow having limbs, comprising:

a main frame to support other components of said bow press;

an adjustment mechanism mounted to said main frame;

a bow limb flexing assembly mounted to said main frame adapted for receiving and flexing the archery bow, said bow limb flexing assembly including two bow limb flexing assembly supports mounted to said main frame, said bow limb flexing assembly including a limb support assembly mounted to each of said two bow limb flexing assembly supports which are adapted to receive and support the archery bow;

a limb inside contact assembly adapted to secure the archer bow against said bow limb flexing assembly and mounted to said adjustment mechanism, whereby said limb inside contact assembly can be moved to due to actuation of said adjustment mechanism; and a bow string support mounted to said limb inside contact assembly, said bow string support adapted to contact and support a bow string of the archery bow away from the archery bow during flexing of the archery bow.

26. A bow press for securing an archery bow having limbs, comprising:

a main frame to support other components of said bow press;

a bow limb flexing assembly mounted to said main frame adapted for receiving and flexing the archery bow, said bow limb flexing assembly including two bow limb flexing assembly supports mounted to said main frame, said bow limb flexing assembly including a limb support assembly mounted to each of said two bow limb flexing assembly supports which are adapted to receive and support the archery bow; and a bow string support mounted to said main frame, said bow string support adapted to contact and support a bow string of the archery bow away from the archery bow during flexing of the archery bow.

* * * * *